United States Patent [19]

Mangan et al.

[11] Patent Number: 4,628,823

[45] Date of Patent: Dec. 16, 1986

[54] VEHICLE SPEED CONTROL TRANSITION MODULE AND METHOD

[75] Inventors: Edmund L. Mangan, Bethlehem; Barry Conklin, Easton, both of Pa.

[73] Assignee: SI Handling Systems, Inc., Easton, Pa.

[21] Appl. No.: 617,216

[22] Filed: Jun. 4, 1984

[51] Int. Cl.[4] ..... B61B 13/00

[52] U.S. Cl. ..... 104/166; 104/165

[58] Field of Search ..... 104/18, 20, 25, 165, 104/166; 198/472, 577, 579

[56] References Cited

U.S. PATENT DOCUMENTS

| | | | |
|---|---|---|---|
| 3,254,778 | 6/1966 | Marland et al. | 198/579 X |
| 3,356,040 | 12/1967 | Fonden | 104/130 |
| 3,811,385 | 5/1974 | Johnson et al. | 104/25 X |
| 3,818,837 | 6/1974 | Jacoby | 104/166 |
| 3,827,545 | 9/1974 | Buhayar | 198/579 X |
| 3,871,303 | 3/1975 | Woodling | 104/25 X |
| 3,880,088 | 4/1975 | Grant | 104/168 |
| 3,881,423 | 5/1975 | Woods et al. | 104/25 |
| 3,992,182 | 11/1976 | Frank | 198/579 X |
| 4,059,053 | 11/1977 | Jones | 104/35 |
| 4,428,298 | 1/1984 | Gutekunst | 104/166 |
| 4,499,991 | 2/1985 | Allen | 104/166 X |

*Primary Examiner*—Robert B. Reeves
*Assistant Examiner*—Scott H. Werny
*Attorney, Agent, or Firm*—Seidel, Gonda, Goldhammer & Abbott

[57] ABSTRACT

The speed of a driverless vehicle is controlled along the length of the module from an incoming high speed to an outgoing low speed or vice versa. The module includes first, second and third aligned drive tubes between tracks adapted to support a vehicle. A first motor is coupled to the first drive tube for driving the same at a first (high) speed. The second drive motor is coupled to the third drive tube for driving the same at a second (low) speed. The second drive tube is maintained out of mechanical engagement with the first and third drive tubes. A variable speed motor is coupled to the second drive tube to drive the second tube between the first (high) and second (low) speeds, independently of the first and second motors.

11 Claims, 2 Drawing Figures

VEHICLE SPEED CONTROL TRANSITION MODULE AND METHOD

BACKGROUND

Figure 1:
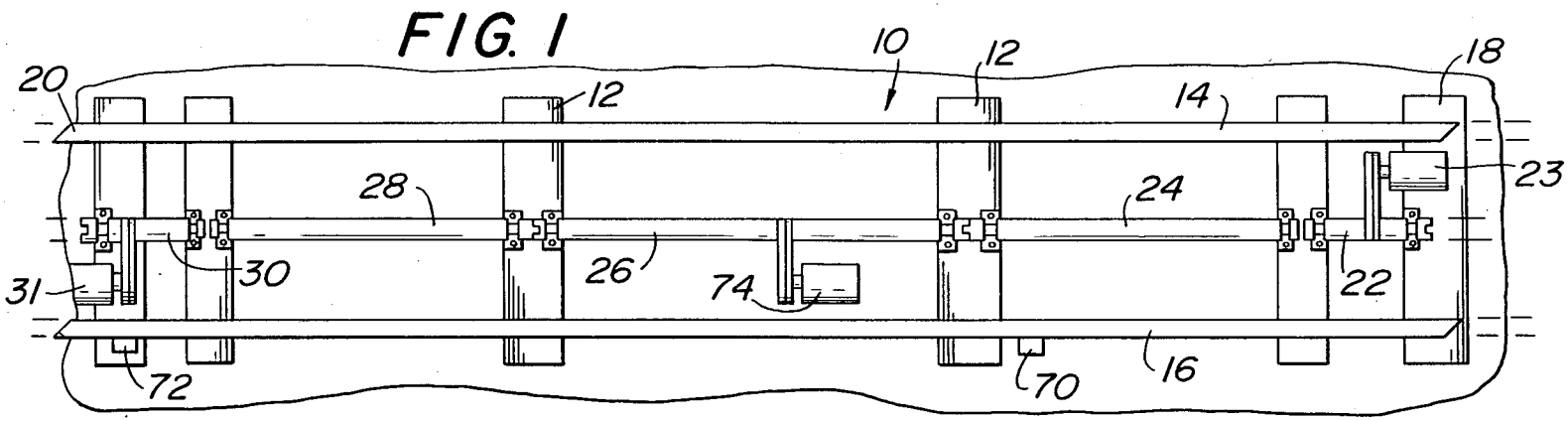

A system of driverless vehicles driven by frictional contact between a drive tube and a drive wheel on the vehicle is disclosed in U.S. Pat. No. 3,356,040. A vehicle of the type adapted for use herein is taught by U.S. Pat. No. 3,818,837.

A vehicle speed control transition module is described in U.S. Pat. No. 4,428,298 for automaticaly reducing or increasing the speed of a driverless vehicle as it moves along the tracks of a conveyor. The invention described in the patent includes a cam means provided along the second drive tube for slowing down or stopping a vehicle as the vehicle moves along the second drive tube. In addition, a clutch means is provided for sequentially enabling only the first motor to drive the first and second drive tubes and then only the second motor to drive the second and third tubes. The second drive tube is initially coupled to the first drive tube, is then disconnected from both the first and third drive tubes until the vehicle is slowed sufficiently, and is then coupled to the third drive tube. After the speed transition is accomplished, the second drive tube is disconnected from the third drive tube and recoupled to the first drive tube.

SUMMARY OF THE INVENTION

The present invention is directed to apparatus for controlling the speed of a driverless vehicle. The apparatus includes a frame for supporting first, second and third aligned drive tubes between tracks adapted to support a vehicle. A first motor is coupled to the first drive tube for rotating the same about its longitudinal axis at a first speed. A second motor is coupled to the third drive tube for rotating the same about its longitudinal axis at a second speed substantially different from the first speed. The second tube is maintained out of mechanical engagement with the first and third drive tubes. Sensor means are provided along the second and third drive tubes for sensing the presence of the vehicle drive wheel on each tube. A variable speed drive means is provided to drive the second tube between the first and second speeds in response to the output of the sensor means, independently of the first and second motors.

It is an object of the present invention to provide a speed control transition module for controlling the speed of a driverless vehicle from a high speed to a low speed and vice versa in an automatic manner which is simple and reliable.

The problem solved is how to provide a speed control transition module which eliminates mechanical components such as the cam means and clutch means disclosed in U.S. Pat. No. 4,428,298 while being simple and reliable.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 1 is a top plan view of a speed control transition module in accordance with the present invention.

Figure 2:
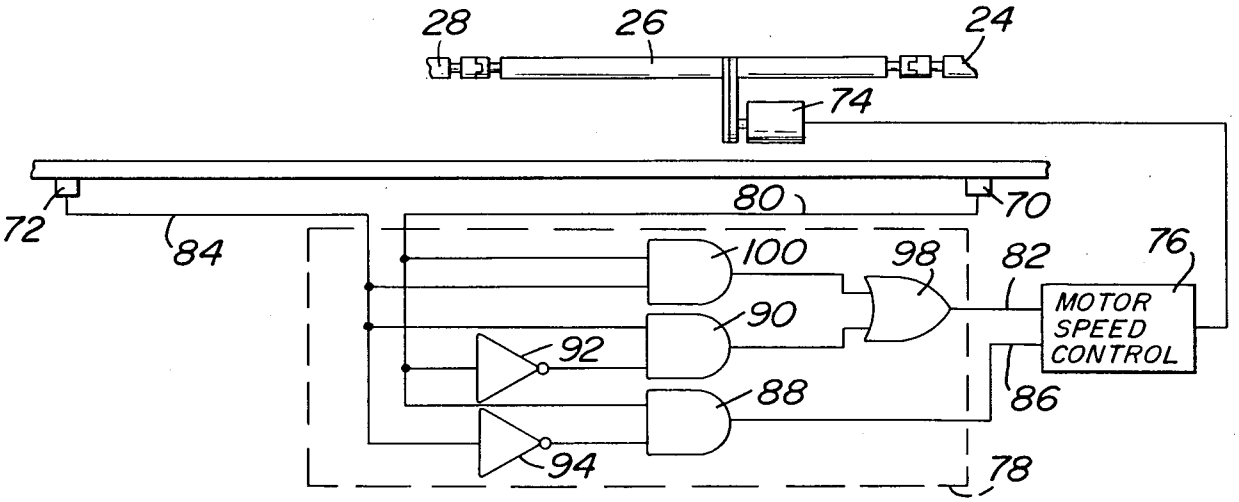

FIG. 2 is a schematic of the signal processing circuitry. cl DETAILED DESCRIPTION Referring to the drawings in detail, wherein like numerals indicate like elements, there is shown in FIG. 1 a speed control transition module in accordance with the present invention designated generally as 10. Module 10 is one module of a conveyor system and is located at an area of the system wherein it is desired to substantially increase or decrease the speed of the driverless vehicle. A typical module length is 20 feet.

For purposes of describing the present invention, it will be assumed that the vehicle moves from right to left in FIG. 1 and enters the module at a high speed. The system will be described in a manner so that the vehicle will exit from the module 10 at a low speed. Representative figures for a high and low speed are 200 feet (6000 cm) per minute and five feet (150 cm) per minute.

The module 10 includes a frame 12 of any suitable construction for supporting the module above ground level. The frame 12 supports rails 14 and 16 for rolling contact with support wheels on a driverless vehicle. One end of the module designated 18 is the inlet end. The exit end is identified as 20. At the inlet end 18, there is provided a first drive tube 22 driven at a high speed by a first drive motor 23 having an output pulley connected to the tube 22 by belts. Tube 22 is aligned with a second drive tube which may be one single tube or may be comprised of aligned segments 24, 26 and 28 coupled together for simultaneous rotation as illustrated. Adjacent the exit end 20, the module is provided with a third drive tube designated 30. Drive tube 30 is driven at a low speed by a second drive motor 31 having its output pulley connected by way of belts to the drive tube 30. The gap between one end of the second drive tube and the first drive tube may be approximately one-half inch (1.2 cm). The gap between the other end of the second drive tube and the third drive tube 30 may also be approximately one-half inch (1.2 cm).

Sensor means, preferably in the form of at least two microswitches or proximity switches 70 and 72 are provided along the frame in a predetermined location in relation to the second and third drive tubes for purposes described hereafter.

The second drive tube is driven at a speed between the first and second speeds by a third drive motor 74 having its output pulley connected by way of belts to the second drive tube. In FIG. 1, the third drive motor 74 is shown connected by way of belts to drive tube segment 26. The speed of motor 74 is varied in response to electric signals provided by an electronic motor speed control 76. See FIG. 2. The speed control 76 determines the speed of motor 74 in response to the output of a signal processing circuit 78. The output of the signal processing circuit 78 is determined by the outputs of switches 70, 72. More specifically, the signal processing circuit 78 commands the motor speed control 76 to increase or decrease the speed of motor 74 based on the outputs of switches 70, 72 as described hereafter.

The module 10 is utilized as follows. A driverless vehicle is transferred onto the module 10 under the influence of motor 23 rotating the drive tube 22 at a high speed. Initially, the motor speed control 76 causes motor 74 to drive the second tube at the high speed. When the drive wheel of the vehicle is supported solely by the second drive tube, switch 70 is triggered by a portion of the vehicle. When switch 70 is triggered, it sends a signal over line 80 to the signal processing circuit 78. The signal processing circuit 78, in turn, transmits a command signal over lines 82, 86 to the motor speed control 76. In response, the motor speed control causes the speed of motor speed 74 to decrease, thereby decreasing the speed of the second drive tube from the high speed. The motor speed control may be programmed to cause the speed of motor 74 to decrease gradually until the motor drives the second tube at the low speed at which time the motor speed control automatically holds the speed of motor 74. As the vehicle moves along the tracks 14, 16, the vehicle speed slows to a speed which approximates the low speed of drive tube 30 which is driven by motor 31.

The vehicle then transfers onto third drive tube 30 and, when the drive wheel of the vehicle is supported solely by the third drive tube, switch 72 is triggered by a portion of the vehicle. When switch 72 is triggered, it sends a signal over line 84 to the signal processing circuit 78. The signal processing circuit 78, in turn, sends a command signal over lines 82, 86 to the motor speed control 76. In response, the motor speed control causes the speed of motor 74 to increase. The motor speed control 76 may be programmed to cause the speed of motor 74 to increase gradually until the motor drives the second tube at the high speed at which time the motor speed control automatically holds the speed of motor 74.

The signal processing circuit 78 shown in FIG. 2 is exemplary only. A wide variety of analog or digital circuit configurations may be employed in conjunction with a suitable motor speed control 76 to vary the speed of motor 74 in response to the condition of switches 70, 72. Thus, the configuration illustrated in FIG. 2 is not intended to be limiting. In the circuit shown in FIG. 2, it is assumed that the switch 70, 72 outputs undergo level transitions when the switches are triggered by the presence of a vehicle and return to initial levels when the switches are not triggered by the vehicle. Two AND gates 88, 90 and inverters 92, 94 are employed to generate the speed increase and speed decrease command signals on lines 82, 86. Initially, when the vehicle is upstream of the second drive tube, switches 70, 72 are not triggered and lines 82, 86 are "low". The motor speed control 76 causes motor 74 to drive the second tube at the high speed, i.e., the nominal speed of first drive tube 22. Assuming that switch 70 is triggered by the vehicle and switch 72 is not, the output of switch 70 changes level and AND gate 88 generates a "high" signal on line 86 and AND gate 90 generates a "low" signal on line 82 via OR gate 98. In response, the motor speed control 76 causes the speed of motor 74 to decrease. The motor speed control 76 is programmed to gradually reduce the speed of motor 74, until the motor 74 drives the second tube at the low speed, and then automatically hold the speed of motor 74. If the output of switch 70 does not reverse at the time switch 72 is triggered by the vehicle, the OR gate 98 is used in conjunction with AND gate 100 to generate a "high" signal on line 82 while AND gate 88 generates a "low" signal on line 86. In turn, the motor speed control 76 causes the speed of motor 74 to increase gradually, until the motor drives the second tube at the high speed, and then holds the speed of motor 74.

If the output of switch 70 reverses after a time interval, before switch 72 is triggered by the vehicle, AND gate 90 generates a "high" signal on line 82 via OR gate 98, and AND gate 88 generates a "low" signal on line 86. In response, the motor speed control 76 causes the speed of motor 74 to increase gradually, until the motor drives the second tube at the high speed, and then holds the speed of motor 74. If the output of switch 72 then reverses after a time interval, the signal processing circuit 78 is reset to its initial condition, i.e., both output lines 82, 86 are "low". For this condition, the motor speed control 76 holds the speed of motor 74 without any change in the motor speed. The speed of the second drive tube is therefore restored to the high speed. If the outputs of switches 70, 72 do not automatically reverse at all after the switches are triggered, a third switch (not shown) may be provided to restore the switch outputs to their initial conditions.

Operation of the motor speed control 76 in response to the signal processing circuit 78 outputs is summarized in Table 1, below:

TABLE 1

| Speed Of Motor 74 | Line 82 | Line 86 |
|---|---|---|
| Increase | High | Low |
| Decrease | Low | High |
| Hold (no motor speed change) | Low | Low |

While the above description relates to slowing down a vehicle so that manufacturing steps may be performed on the work carried by the vehicle, the present invention may also be utilized to increase the speed of the vehicle as it moves along the conveyor. Thus, the present invention provides a speed control in the form of a transition module so that portions of a conveyor system may cause a driverless vehicle to move at a high speed while other portions of the system cause the vehicle to move at a low speed. Depending upon the length of the module, the second drive tube may be a single tube or may be segmented into a plurality of segments as illustrated in the drawing and described above.

The present invention avoids wearing out drive wheels and avoids jolting a load on the vehicle when changing from one speed to another. The present invention enables the speed of the vehicle to be changed gradually over a short distance such as four to eight feet depending upon the entry speed, the weight of the load, and the length of the drive wheel assembly. The present invention eliminates the cam and clutch mechanisms described in U.S. Pat. No. 4,428,298. The second drive tube is maintained out of mechanical engagement with the first and third drive tubes at all times. All three drive tubes are independently driven. The speed of the second drive tube is controlled electronically in response to the condition of switches 70, 72 by signal processing circuit 78 and motor speed control 76. Speed control is attained within seconds while utilizing structural components which are simple, inexpensive and reliable.

The present invention may be embodied in other specific forms without departing from the spirit or essential attributes thereof, and, accordingly, reference should be made to the appended claims, rather than to the foregoing specification, as indicating the scope of the invention.

We claim:

1. Apparatus for controlling the speed of a driverless vehicle comprising a stationary frame supporting first, second and third aligned drive tubes between tracks which are adapted to support a driverless vehicle, the ends of said second tube being at all times mechanically disengaged from the adjacent ends of the first and third tubes, a first motor coupled to the first drive tube for rotating the same about its longitudinal axis at a first speed, a second motor coupled to the third drive tube for rotating the same about its longitudinal axis at a second speed which is different from said first speed, sensor means disposed along the frame for actuation by a driverless vehicle, and variable speed drive means responsive to said sensor means and coupled to the second drive tube for rotating the same about its longitudinal axis and for varying the speed of rotation of the second tube between the first and second speeds.

2. Apparatus in accordance with claim 1 wherein said variable speed drive means includes a signal processing circuit connected to said sensor means for generating speed increase and speed decrease command signals in response to the condition of said sensor means, a variable speed motor coupled to the second tube, and a motor speed control for varying the speed of the variable speed motor in response to the output of the signal processing circuit.

3. Apparatus in accordance to claim 1 wherein said second drive tube is comprised of a plurality of coaxial segments coupled together for rotation as a unit.

4. Apparatus in accordance with claim 1 wherein said sensor means comprises a plurality of switches arranged to control the variable speed drive means as a function of the location of a driverless vehicle.

5. Apparatus for automatically controlling the speed of a driverless vehicle comprising a stationary frame supporting first, second and third aligned drive tubes between tracks on said frame and which are adapted to support a driverless vehicle, means for independently driving said first, second and third drive tubes such that each tube, when driven, rotates about its longitudinal axis, sensor means disposed along the frame for actuation by a driverless vehicle, and said means for independently driving said drive tubes including variable speed drive means responsive to said sensor means for driving the second tube between first and second speeds.

6. Apparatus in accordance with claim 5 wherein said variable speed drive means includes a variable speed motor coupled to the second drive tube for rotating the same about its longitudinal axis, signal processing means for generating speed increase and speed decrease command signals based on the outputs of said sensor means, and a motor speed control for varying the speed of the variable speed motor between said first and second speeds based on said speed increase and speed decrease command signals.

7. Apparatus in accordance with claim 5 wherein said second speed is substantially lower than said first speed.

8. Apparatus in accordance with claim 5 wherein the second speed is substantially higher than the first speed.

9. Method of automatically controlling the speed of a driverless vehicle which travels along first, second and third aligned drive tubes by frictional contact therewith, including maintaining said first, second and third drive tubes out of mechanical engagement with each other at all times, sensing the location of the driverless vehicle, driving the first drive tube at a first speed, driving the third drive tube at a second speed, and varying the speed of the second drive tube from said first speed to said second speed based on the sensed location of the driverless vehicle while the vehicle is driven by contact with the second drive tube.

10. Method of automatically controlling the speed of a driverless vehicle which travels along first, second and third aligned drive tubes, including propelling a driverless vehicle into frictional contact with the second drive tube from the first drive tube at a first speed, then varying the speed of the second drive tube from said first speed to a second speed while maintaining the second drive tube out of mechanical engagement with the first and third drive tubes, and then propelling the vehicle from the second drive tube to the third drive tube at the second speed which is different from the first speed while maintaining the second drive tube out of mechanical engagement with the first and third drive tubes.

11. A method in accordance with claim 10 including driving said first and third drive tubes using discrete fixed speed motors, and driving said second drive tube using a discrete variable speed motor.

* * * * *